US008036403B2

(12) United States Patent
Xi

(10) Patent No.: US 8,036,403 B2
(45) Date of Patent: Oct. 11, 2011

(54) DIRECTIONAL SOUND WAVE RADIATOR

(75) Inventor: Baoshu Xi, Beijing (CN)

(73) Assignee: Beijing Wave Energy Technology Development Company, Ltd., Beijing (CN)

( * ) Notice: Subject to any disclaimer, the term of this patent is extended or adjusted under 35 U.S.C. 154(b) by 688 days.

(21) Appl. No.: 12/184,756

(22) Filed: Aug. 1, 2008

(65) Prior Publication Data

US 2009/0034779 A1 Feb. 5, 2009

(30) Foreign Application Priority Data

Aug. 3, 2007 (CN) ..... 2007 1 0119916

(51) Int. Cl.
*H04R 25/00* (2006.01)

(52) U.S. Cl. ..... 381/160; 381/339; 381/340; 381/341; 381/387; 181/187; 181/191; 181/192; 181/194

(58) Field of Classification Search ..... 381/160, 381/335–337, 339–341, 345, 352, 356, 387, 381/430; 181/152, 153, 156, 159, 177, 179, 181/187, 191, 192, 194, 195
See application file for complete search history.

(56) References Cited

U.S. PATENT DOCUMENTS

| | | | | | |
|---|---|---|---|---|---|
| 1,641,664 | A | * | 9/1927 | De Forest | 381/340 |
| 1,737,864 | A | * | 12/1929 | Perla et al. | 181/191 |
| 2,638,510 | A | * | 5/1953 | Brami | 381/341 |
| 4,865,159 | A | * | 9/1989 | Jamison | 181/179 |
| 4,896,134 | A | * | 1/1990 | Hayashi | 340/387.1 |
| 4,982,436 | A | * | 1/1991 | Cowan | 381/341 |
| 5,220,608 | A | * | 6/1993 | Pfister | 381/17 |
| 6,031,920 | A | * | 2/2000 | Wiener | 381/160 |

* cited by examiner

*Primary Examiner* — Ramon Barrera
(74) *Attorney, Agent, or Firm* — Oliff & Berridge, PLC

(57) ABSTRACT

The present invention belongs to the field of loudspeaker and relates to directional sound wave radiator comprising a sound transmission duct, a reverser, an annular director, a parabolic reflector, and a straight tubular loudspeaker cylinder. The sound transmission duct is mounted substantially coaxially with said parabolic reflector. The straight tubular loudspeaker cylinder is connected to said parabolic reflector. The reverser is provided inside said straight tubular loudspeaker cylinder and at the outlet end of said sound transmission duct; the outlet end of said reverser has an annular section, which is substantially perpendicular to the axis of said parabolic reflector and is positioned substantially at the focus of said parabolic reflector. The annular director is mounted around said sound transmission duct and at the outlet end of said reverser to define an annular shape of the outlet end of said reverser. The reverser and said annular director are fixed to said sound transmission duct by supporting screws.

10 Claims, 3 Drawing Sheets

DIRECTIONAL SOUND WAVE RADIATOR

REFERENCE TO RELATED APPLICATIONS

This application claims foreign priority benefits from Chinese Patent Application No. 200710119916.9, filed Aug. 3, 2007.

FIELD OF THE INVENTION

The present invention relates to directional sound wave radiator, particularly to a directional sound wave radiator for use in high power, long distance and high intensity sound broadcasting. The present invention belongs to the technical field of loudspeaker.

BACKGROUND OF THE INVENTION

Conventionally, most loudspeaker horns have exponential curve, suspension line curve, or conical line shapes. FIG. 1 shows a conventional loudspeaker horn having an exponential curve shape. As shown in FIG. 1, such a conventional loudspeaker has a sound-generating head 1, an exponential horn 2, an exponential horn outlet section 3, and a reverser section 4. The loudspeaker horn works by utilizing a horn curve to provide certain resistance to the sound source (sound-generating head) to obtain an optimal efficiency of sound propagation. To reduce the length of horn, it is often made in three sections, in which the intermediate section is a reverser section, thus forming a folded structure, as indicated in FIG. 1, and its high-frequency response usually suffers some attenuation. Such a structure has the defect that its sound wave radiation angle at the output end is large, so the sound wave energy is not concentrated and the propagation distance is limited. For long distance and/or high-intensity broadcasting, energy must be concentrated in a small range, which can hardly be achieved using conventional loudspeakers.

SUMMARY OF THE INVENTION

In one respect, the present invention aims to provide a directional sound wave radiator, which differs from conventional loudspeaker structure in that it radiates sound wave as a narrow beam of wave so that it can realize more concentrated beam of sound energy than conventional loudspeakers, while it can realize smaller size to facilitate its movement.

A directional sound wave radiator according to an embodiment of the present invention comprises a sound transmission duct, a reverser, an annular director, a parabolic reflector, and a straight tubular loudspeaker cylinder; the sound transmission duct is arranged on the axis of the parabolic reflector; the straight tubular loudspeaker cylinder is connected to the parabolic reflector; the reverser is provided within the straight tubular loudspeaker cylinder and at the end of the sound transmission duct; the outlet end of the reverser has an annular section, which is perpendicular to the axis of the parabolic reflector and is positioned near the focus of the parabolic reflector; the annular director is mounted around the sound transmission duct and at the outlet end of the reverser to define said annular section at the outlet of the reverser.

In an embodiment, the reverser and the annular director are fixed on the sound transmission duct by supporting screws.

In an embodiment, the focal length of the parabolic reflector of the directional sound wave radiator of the present invention can be in the range of 50-1200 mm, the diameter D of the straight tubular loudspeaker cylinder can be in the range of 200-4,000 mm, and the length L of the straight tubular loudspeaker cylinder can be in the range of 100-2,000 mm.

In an embodiment, the area $S_0$ of the inlet end of the sound transmission duct and the area S of the annular section at the outlet end of the reverser has the relation of $S=S_0e^m$, where m is the sum of the length g of the sound transmission duct and the length h of the central line from the outlet of the sound transmission duct to the outlet of the reverser, i.e., m=g+h.

In an embodiment, the outlet end of the annular director has an exit angle $\alpha$, and said exit angle $\alpha$ is such that a line incident on said parabolic reflector from said outlet end in the exit angle $\alpha$ is reflected by said parabolic reflector in a direction which is substantially parallel to the axis of the parabolic reflector.

The directional sound radiator of the present invention has the advantage that it has a relatively small sound wave radiation angle at its outlet end so that the sound wave energy is more concentrated for propagation over longer distance. In addition, it has a smaller overall size of loudspeaker, which is suitable for being included in a movable station for broadcasting high-intensity sound. With the directional sound radiator of the present invention, sound wave energy is concentrated on the sound axis. The sound pressure level on the sound axis of the loudspeaker of the present invention can be increased with respect to that of other loudspeakers by about 10-15 dB, with its sound beam range (−6 dB) being kept within ±15°. Thus, sound wave can be concentrated for longer propagation.

DETAILED DESCRIPTION

The present invention is described in detail below with reference to its specific embodiments.

Figure 1:
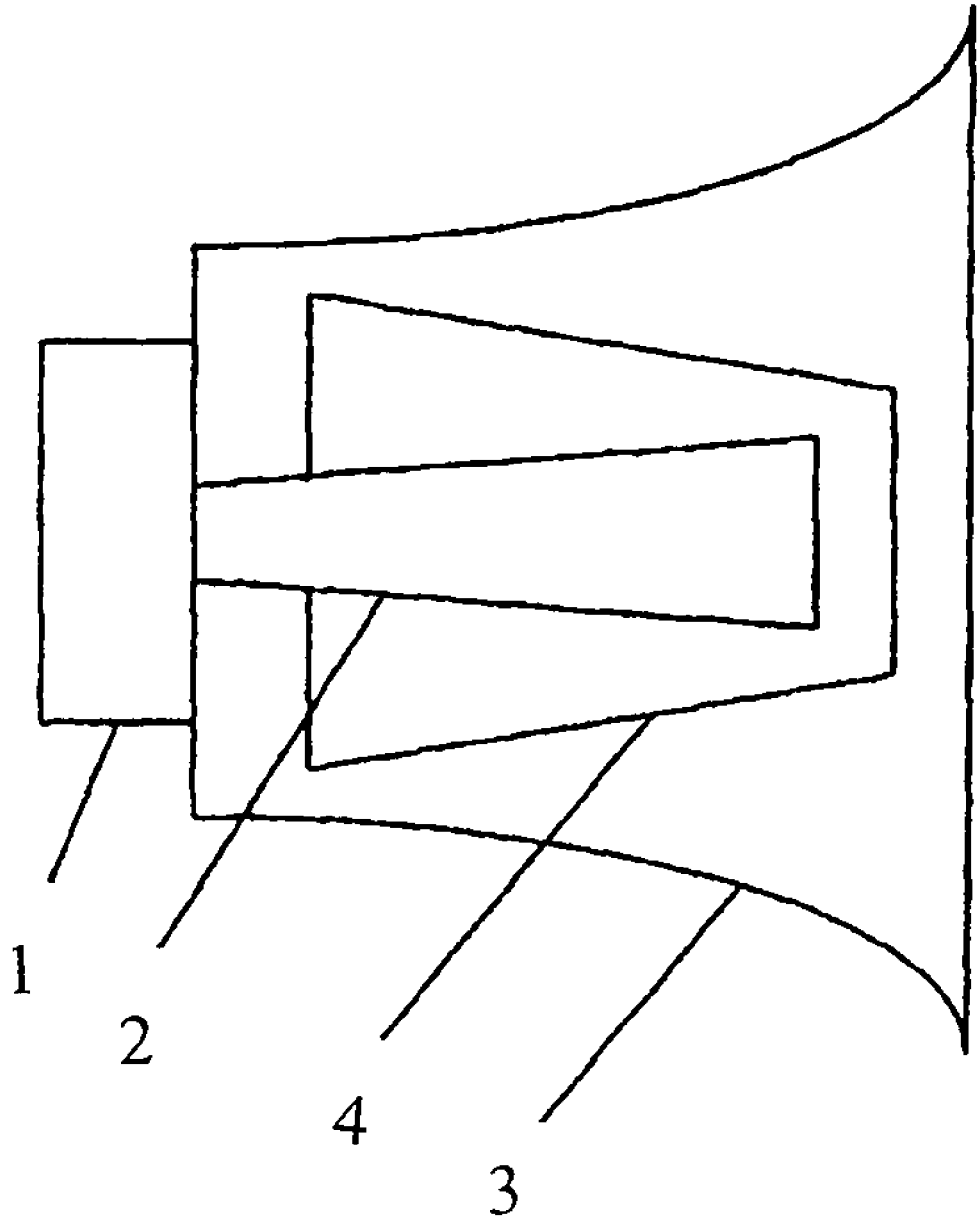
FIG. 1 PRIOR ART
FIG. 1 is a schematic diagram showing the structure of a conventional loudspeaker.
Figure 2:
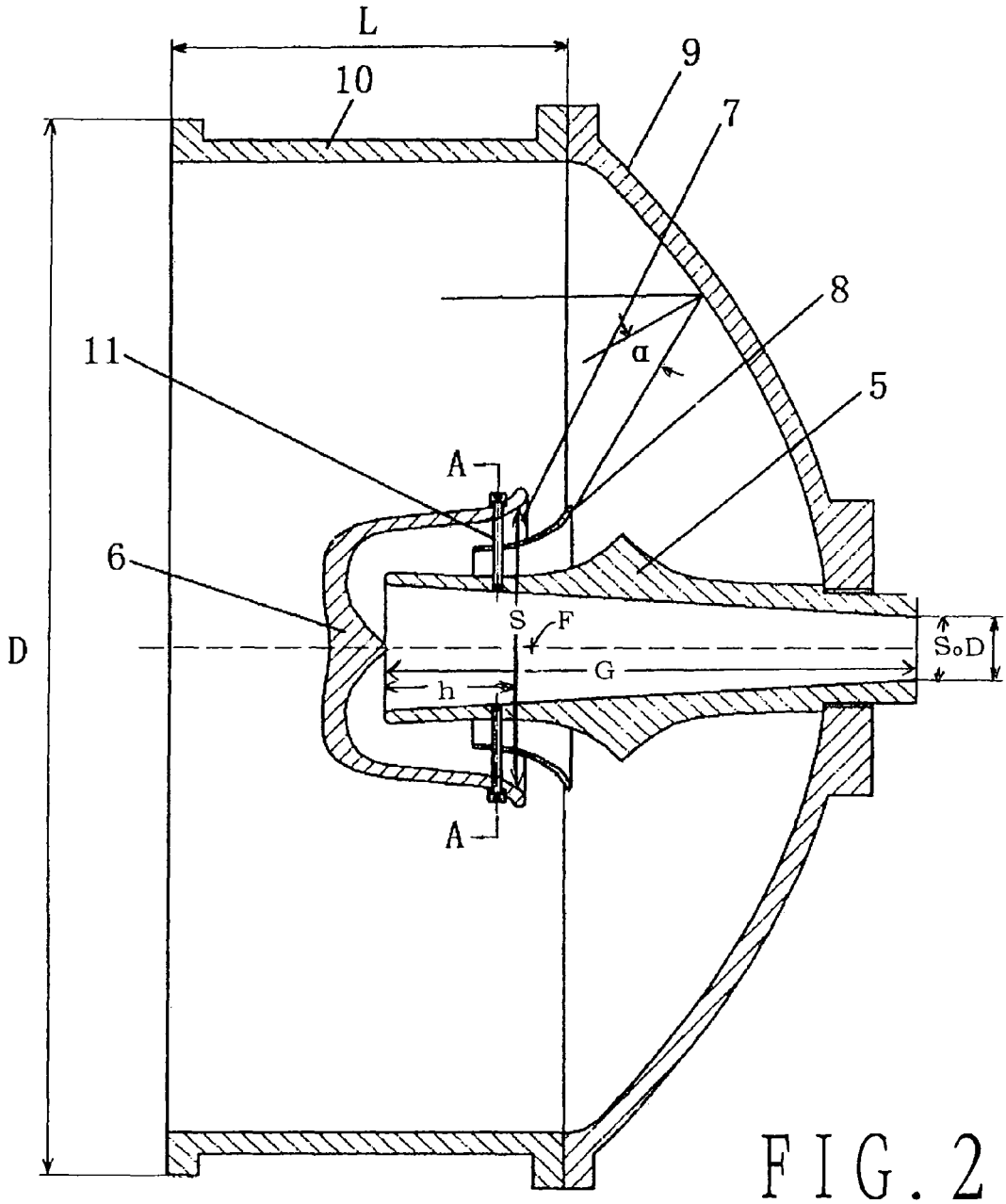
FIG. 2 is a schematic diagram showing the structure of a directional sound wave radiator of an embodiment of the present invention.

As shown in FIG. 2, a directional sound wave radiator of an embodiment of the present invention comprises a sound transmission duct 5, a reverser 6, an annular director 8, a parabolic reflector 9, and a straight tubular loudspeaker cylinder 10. Sound transmission duct 5 is arranged on the axis of parabolic reflector 9. Straight tubular loudspeaker cylinder 10 is connected to parabolic reflector 9. Reverser 6 is provided within straight tubular loudspeaker cylinder 10 and is arranged at the end of sound transmission duct 5. The outlet end of reverser 6 has an annular section, which is perpendicular to the axis of parabolic reflector 9 and is positioned approximately at the focus F of parabolic reflector 9. Annular director 8 is mounted around sound transmission duct 5 and at the outlet end of reverser 6 to define said annular section at the outlet of reverser 6.

Figure 3:
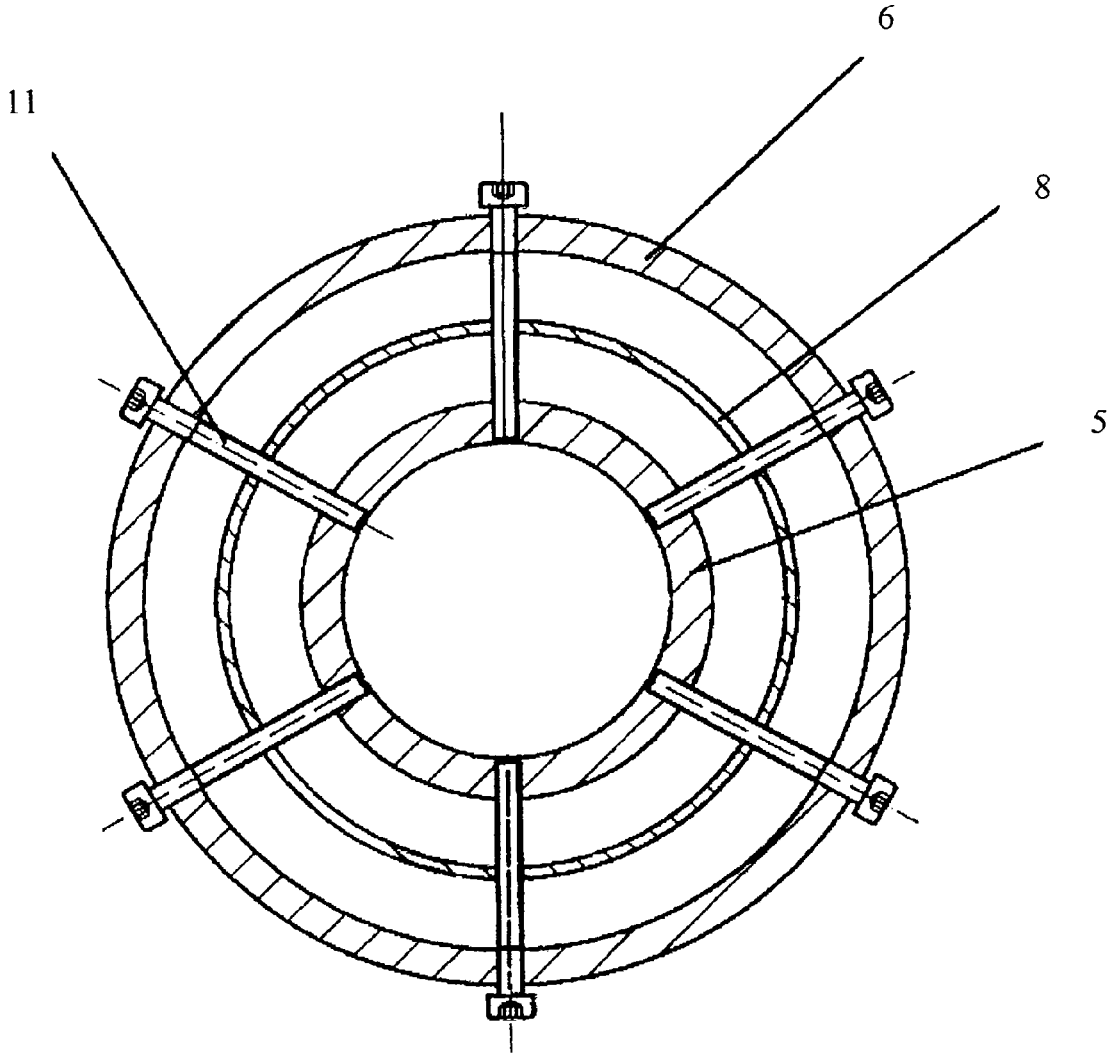
FIG. 3 is a sectional view along line A-A in FIG. 2.

In an embodiment, reverser 6 and annular director 8 are fixed to sound transmission duct 5 by supporting screws 11, as shown in FIG. 3.

In an embodiment, the focal length of the parabolic reflector of the directional sound wave radiator of the present invention can be in the range of 50-1200 mm, the diameter D of the straight tubular loudspeaker cylinder can be in the range of 200-4,000 mm, and the length L of the straight tubular loudspeaker cylinder can be in the range of 100-2,000 mm.

In an embodiment, the area $S_0$ of the inlet end of the sound transmission duct and the area S of the annular section at the outlet end of the reverser has a relation of $S=S_0e^m$, where m is the sum of the length g of the sound transmission duct and the length h of the central line from the outlet of the sound transmission duct to the outlet of the reverser; i.e., m=g+h.

In an embodiment, the outlet end of the annular director has an exit angle α, and said exit angle α is such that a line extending in the exit angle α from the outlet end the annular director to the parabolic reflector is reflected by the parabolic reflector in a direction which is substantially parallel to the axis of the parabolic reflector.

The sound transmission duct and the reverser of a directional sound wave radiator according to an embodiment of the present invention have conventional exponential curves; that is, the inner walls of its sound transmission duct and reverser each follows an exponential curve.

A directional sound radiator according to an embodiment of the present invention has the advantage that it has a relatively small sound wave radiation angle at its outlet end, so the sound wave energy is more concentrated for propagation over longer distance. In addition, it has a smaller overall size of loudspeaker, allowing it to be suitable for being included in a movable station for broadcasting high-intensity sound.

During operation of a directional sound wave radiator according to an embodiment of the present invention, sound wave generated by a sound generator (not shown) is transmitted to reverser 6 through sound transmission duct 5. The sound wave is reversed by reverser 6, is transmitted to sound wave emitting port 7 of reverser 6 under the effect of annular director 8, and is emitted to parabolic reflector 9 in a direction set by annular director 8. Because of the focusing effect of parabolic reflector 9, sound wave reflected by parabolic reflector 9 is concentrated to a beam of narrow sound wave, so its energy is concentrated and sound intensity is greatly increased. To further concentrate sound wave, straight tubular loudspeaker cylinder 10 is mounted outside parabolic reflector 9 to reduce sound intensity at the back of the loudspeaker and to further enhance forward-going sound wave.

In a specific example an embodiment of the directional sound wave radiator of the present invention, sound wave generated by a sound-generating head (not shown) is transmitted to reverser 6 through sound transmission duct 5. The center of the outlet port of reverser 6 is substantially positioned at the focus of parabolic reflector 9, and the outlet plane of reverser 6 is perpendicular to the axis of parabolic reflector 9. In this example, the sound-generating head has a diameter of 50 mm, the outlet of reverser 6 has a diameter of 220 mm. Annular director 8 is provided at the outlet of reverser 6. Reverser 6, annular director 8, and sound transmission duct 5 are connected and fixed by screws 11. Annular director 8 has an outlet angle α, which directs sound wave to emit toward parabolic reflector 9 substantially in a preset direction. The inlet of annular director 8 (the end having a smaller diameter) is on the central line of the annular section defined by reverser 6 and sound transmission duct 5 and is perpendicular to the annular section. Thus, sound wave reflected by the parabolic reflector emits substantially parallel to the axis of the parabolic reflector. As sound wave emitting port 7 is an annular area rather than a point source, the sound wave after reflection by parabolic reflector is not a completely parallel beam; rather it is a beam with a small angle of divergence, which is typically in the range of ±10°-±15°. Sound transmission duct 5 is arranged at the center of parabolic reflector 9. Sound-generating head (not shown) is arranged behind parabolic reflector 9. Straight tubular loudspeaker cylinder 10 is mounted in front of parabolic reflector 9 to reduce sound intensity to the back of the loudspeaker and to further enhance forward-going sound wave. Parabolic reflector 9 and straight tubular loudspeaker cylinder 10 both have a diameter D. Straight tubular loudspeaker cylinder 10 has a length L. Values of L and D depend on the level of radiated sound energy and the frequency range of the sound to be radiated and can vary greatly. In a specific example of an embodiment of the present invention, D=600 mm, and L=300 mm.

What is claimed is:

1. A directional sound wave radiator comprising:
a sound transmission duct,
a reverser,
an annular director,
a parabolic reflector, and
a straight tubular loudspeaker cylinder,
wherein said sound transmission duct is mounted substantially coaxially with said parabolic reflector,
wherein said straight tubular loudspeaker cylinder is connected to said parabolic reflector,
wherein said reverser is provided inside said straight tubular loudspeaker cylinder and at the outlet end of said sound transmission duct, the outlet end of said reverser has an annular section, which is substantially perpendicular to the axis of said parabolic reflector, and said annular section is positioned substantially at the focus of said parabolic reflector, and
wherein said annular director is mounted around said sound transmission duct and at the outlet end of said reverser to define an annular shape of the outlet end of said reverser.

2. A directional sound wave radiator of claim 1, wherein said parabolic reflector has a focal length ranging from 50 mm to 1200 mm, said straight tubular loudspeaker cylinder has a diameter ranging from 200 mm to 4,000 mm and a length ranging from 100 mm to 2,000 mm.

3. A directional sound wave radiator of claim 1, wherein the inlet end of said sound transmission duct has a sectional area $S_0$ and the annular section at the outlet end of said reverser has a sectional area S, with $S_0$ and S having the relation of $$S=S_0e^m$$

where m is the sum of length g of said sound transmission duct and length h of the central line extending from the outlet end of said sound transmission duct to the outlet end of said reverser, i.e., m=g+h.

4. A directional sound wave radiator of claim 1, wherein the outlet end of said annular director has an exit angle α, and said exit angle α is such that a line incident on said parabolic reflector from said outlet end in the exit angle α is reflected by said parabolic reflector in a direction which is substantially parallel to the axis of the parabolic reflector.

5. A directional sound wave radiator of claim 1, wherein said reverser and said annular director are fixed to said sound transmission duct by supporting screws.

6. A directional sound wave radiator, comprising:
a parabolic reflector,
a sound transmission duct arranged substantially coaxially with said parabolic reflector and having an outlet end,
a reverser arranged at said outlet end of said sound transmission duct and having an outlet end,
an annular director means provided at the outlet end of said reverser for directing sound wave emitted from said outlet end of said reverser in such a way that said sound wave are emitted substantially in the direction as from the focus of said parabolic reflector.

7. A directional sound wave radiator of claim 6, wherein said outlet end of said reverser has an annular section substantially perpendicular to the axis of said parabolic reflector, and said annular section being positioned substantially at the focus of said parabolic reflector.

8. A directional sound wave radiator of claim 6, further comprising a straight tubular loudspeaker cylinder connected to said parabolic reflector.

9. A directional sound wave radiator of claim 6, wherein said reverser and said annular director are mounted to said sound transmission duct by supporting screws, said supporting screws are arranged in substantially one plane substantially perpendicular to the axis of said parabolic reflector, and said supporting screws extend substantially radially with respect to the axis of said parabolic reflector.

10. A directional sound wave radiator of claim 6, wherein the outlet end of said annular director has an exit angle $\alpha$, and said exit angle $\alpha$ is such that a line extending in the exit angle $\alpha$ from the outlet end the annular director to the parabolic reflector is reflected by the parabolic reflector in a direction which is substantially parallel to the axis of the parabolic reflector.

* * * * *